US009228383B2

(12) United States Patent
Svatos et al.

(10) Patent No.: US 9,228,383 B2
(45) Date of Patent: Jan. 5, 2016

(54) HINGE COMPRISING A TEXTILE

(71) Applicant: F. A. Kuempers GmbH & Co. KG, Rheine (DE)

(72) Inventors: Petr Svatos, Police nad Metuji (CZ); Rudolf Bonse, Muenster (DE); Joan-Dirk Kuempers, Rheine (DE)

(73) Assignee: F. A. Kuempers GmbH & Co. KG, Rheine (DE)

( * ) Notice: Subject to any disclaimer, the term of this patent is extended or adjusted under 35 U.S.C. 154(b) by 16 days.

(21) Appl. No.: 13/859,876

(22) Filed: Apr. 10, 2013

(65) Prior Publication Data

US 2014/0304946 A1 Oct. 16, 2014

(51) Int. Cl.
*E05D 1/02* (2006.01)

(52) U.S. Cl.
CPC . *E05D 1/02* (2013.01); *Y10T 16/525* (2015.01)

(58) Field of Classification Search
CPC ... Y10T 16/522; Y10T 16/525; Y10T 16/555; B60R 21/2165; B60R 21/2171; B60R 2021/21537; E05D 1/00; E05D 1/02; E05D 7/00
USPC ..... 16/225, 223, 385; 280/728.3
See application file for complete search history.

(56) References Cited

U.S. PATENT DOCUMENTS

| | | | | |
|---|---|---|---|---|
| 5,564,733 | A | 10/1996 | Duenas et al. | |
| 6,145,879 | A * | 11/2000 | Lowe et al. | 280/743.1 |
| 7,611,163 | B2 | 11/2009 | Schweizer et al. | |
| 7,878,528 | B2 | 2/2011 | Dorn | |
| 8,096,577 | B2 * | 1/2012 | Roring et al. | 280/728.3 |
| 8,157,289 | B2 * | 4/2012 | Bittner et al. | 280/728.3 |
| 8,348,303 | B1 * | 1/2013 | Roring et al. | 280/728.3 |
| 8,393,635 | B2 | 3/2013 | Laboeck et al. | |
| 8,414,016 | B2 * | 4/2013 | Buhler | 280/728.3 |
| 8,523,221 | B2 * | 9/2013 | Muller | 280/730.2 |
| 2010/0117339 | A1 * | 5/2010 | Roring | 280/728.3 |
| 2011/0062686 | A1 | 3/2011 | Buhler | |
| 2014/0054878 | A1 * | 2/2014 | Nogaret et al. | 280/728.3 |

FOREIGN PATENT DOCUMENTS

| | | |
|---|---|---|
| DE | 44 37 773 | 10/1995 |
| DE | 198 34 384 | 2/2000 |
| DE | 199 35 625 | 2/2001 |
| DE | 103 45 026 | 5/2005 |
| DE | 10 2004 010 643 | 10/2005 |
| DE | 10 2007 055 016 | 11/2008 |
| DE | 10 2007 035 073 | 2/2009 |
| DE | 10 2008 011 519 | 9/2009 |
| DE | 10 2010 047 750 | 4/2012 |
| EP | 2 439 112 | 4/2012 |

* cited by examiner

*Primary Examiner* — William Miller
(74) *Attorney, Agent, or Firm* — Collard & Roe, P.C.

(57) ABSTRACT

The invention relates to a hinge comprising a textile which connects a first part (2) and a second part (4) to one another, where the textile (3) has a gauze made of loops between the parts.

3 Claims, 1 Drawing Sheet

HINGE COMPRISING A TEXTILE

BACKGROUND OF THE INVENTION

1. Field of the Invention

The invention relates to a hinge comprising a textile which connects a first part and a second part to one another.

2. The Prior Art

Such hinges in which, for example, a flexible woven fabric is used instead of a pin connection are particularly favourable in manufacture when the textile can be incorporated into at least one of the parts to be connected in a hinge-like manner during the manufacture thereof.

One area of application for a textile hinge is the manufacture of airbag flaps. Here the folded airbag is located behind the flap. The flap is incorporated in a cladding with a circumferential predetermined breaking point. As the air sack of the airbag unfolds, this predetermined breaking point is forced open. A hinge on one side of the flap on the one hand allows opening of the flap so that the airbag can pass through the opening and on the other hand this hinge ensures that the flap opens in a controlled manner and contact of the flap with other objects or the passenger is avoided. The flap can be held here by a hinge or a retaining cable.

The Unexamined Laid-Open Patent Application DE 198 34 384 discloses an instrument panel which is held by means of a catch strap, where this provides a loose surface region in the rest position of the airbag flap which holds the airbag flap in the off position.

An instrument panel having a surface hinge is disclosed in DE 10 2004 010 643 A1, where the hinge has an overlength which prevents the unfolding airbag flap from springing back. The overlength is designed as a loop and is fastened with an additional element.

DE 10 2007 055 016 B3 discloses a cladding part with airbag cover and a method for its manufacture. Here the hinge is fastened and embedded with overlength on a web formed in the airbag flap.

The patent specification DE 44 37 773 C1 discloses the connection of a flap hinge to an airbag flap, where the hinge is pressed into the reinforcing plate.

DE 199 35 625 A1 discloses a reinforcing structure comprising a fibre fabric in which twisted, plied or looped fibres are used. A woven fabric, netting or knitted fabric thus formed allows a greater elongation according to the invention so that an undesirable cracking of the fibre fabric is prevented.

The patent specification DE 103 45 026 B4 discloses an inner cladding part with an insert as hinge, where the insert is configured so that during an opening impact of the airbag, a certain amount of energy is absorbed so that the insert becomes detached from the intermediate layer. The insert is designed as a spacer knitted fabric, preferably as a thread knitted fabric.

DE 10 2008 011 519 A1 discloses a textile flat fabric having an initial weakening for tearing open, where the further tearing force of the textile surface structure is lower in a preferential direction than in all the other directions.

DE 10 2007 035 073 A1 describes a hinge for an airbag flap which is designed as knitted or crocheted fabric and has a plurality of inlaid or standing yarns which are arranged at an angle of at least 15° to the hinge-side edges of the airbag flap. It is considered to be advantageous in this invention that during breaking out of the airbag flap, the translatory motion of the flap is converted in a damped manner into a rotatory motion whereby the knitted fabric threads, preferably made of polyester, have a lower strength than the inlaid or standing yarns. Since the knitted fabric thread breaks at an elongation of about 40%, the flap is held by the high-strength standing threads which extend perpendicular to the axis of rotation of the hinge.

Textile surfaces structures have proved advantageous compared with hinges made of metal. These are lighter and form no risk for the occupants in the case of failure. A disadvantage in designs in which the overlength of the textile surface structure is designed as a loop has proved to be that the textile surface structure cannot be fed in an automated fashion into the injection mould of the cladding part.

It has also been found to be disadvantageous in the mesh fabrics used that the warp or weft threads can be released from the injection moulded parts with relatively low force and then result in component failure. The mesh structures are therefore mostly designed as leno fabrics and additionally strengthened by means of an application. In addition, these designs are usually not only overmoulded with the polymer of the cladding part and the airbag flap but are expensively fastened by means of additional elements such as screws or rivets to the cladding part and the airbag flap.

SUMMARY OF THE INVENTION

It is therefore the object of the invention to further develop a hinge comprising a textile which connects a first part and a second part to one another.

This object is solved by a generic hinge in which the textile is a woven fabric and has a gauze made of loops between the parts.

A defined length can be fixed by means of the length of the loops of the textile lying between the parts, which is advantageous during movement of the hinge. During the processing of the textile the loops are present as a gauze, where the loops either only lie between the parts or are connected to the parts.

The loops lying between the parts during the processing and also during the deployment in the airbag cover flap are completely forceless. As in a terry towel, the fabric forms a base structure which absorbs a tensile stress without a force acting on the loops. The loops are selected to be sufficiently large so that even when the base fabric is under a large stressing which results in a certain lengthening of the base fabric, the loops still remain unstressed. Even when a large force is applied to the base fabric, no forces therefore act on the loops. Only when a thread in the base structure tears, are the loops deployed.

The textile can be inserted in an automated fashion into an injection moulding tool and it is thereby possible to join the textile to the two parts without additional elements.

For example, the hinge can connect an airbag flap as a first part to a cladding part as a second part without additional elements. Advantageously there is a small free length between the parts in which the gauze is not injection moulded. This results in a defined lengthening for a secure rotation of the airbag flap. The maximum lengthening is thereby held tunably in a defined manner within narrow tolerances according to the application in order to ensure secure opening of the airbag flap on the one hand and on the other hand to ensure that the airbag flap does not collide with any other objects and poses no risk for the occupants of the vehicle.

It is advantageous if the loops are disposed as a row of loops. In particular when the textile is manufactured as a woven fabric, it is easily possible to incorporate one or several rows of loops into the textile, which, on the one hand as free rows of loops between the parts to be joined, ensure a defined lengthening and on the other hand, can ensure good anchoring of the textile into the parts during injection moulding of the textile into the parts. In order to save material for the gauze and in order to ensure a defined lengthening, one or more rows of loops can also be provided exclusively in the region between the parts.

In order to be able to keep the loops in the gauze of the textile as short as possible, it is proposed that a plurality of rows of loops are disposed adjacent to one another.

Such rows of loops can be produced in different textiles. However, such loops can be produced relatively easily if the textile is a woven fabric.

In this case it is proposed that the loops are formed in the warp.

Since it is advantageous if the loops are formed from a stronger material than the usual textile material, it is proposed that the loops are formed from an aramid material.

This enables the usual material of the textile to be produced from a more favourable material so that the loop material is more tear-proof than the remaining material of the textile.

It is advantageous if the textile comprises a double warp fabric whose base warp has a lower strength than the pile warp. Here the base warp can consist of spun yarns or filaments of lower strength and high elongation, preferably of polyester. The pile warp preferably consists of spun yarns or filaments of high strength, preferably of aramids.

The strength of the base warp is preferably adjusted so that the base warp has a strength of 500 N/5 cm to 2,000 N/5 cm. As a result, the strength of the base fabric lies in this range and preferably between 800 N/5 cm and 1,200 N/5 cm.

In a preferred exemplary embodiment, the strength of the pile warp is at least 1.3 times the strength of the base warp. The setting of the pile warp is therefore selected so that the strength of the pile fabric is 1.3 to 10 times higher than that of the base fabric, preferably greater than 1,800 N/5 cm if the strength of the base fabric is 1,000 N/5 cm.

In order that the retaining thread of the fabric in contrast to a mesh lies ideally in the direction of the tensile stress, it is proposed that the loops are formed in a thread running transversely to the hinge line of the hinge. Preferably this thread even runs precisely orthogonally to a hinge line of the hinge.

The retaining threads should be formed very stably. These threads are therefore relatively expensive. On account of the configuration of the loops, particularly many threads are required with the result that the costs increase further. It is therefore proposed that the textile only has loops between the parts. Since the textile is preferably injection moulded in the parts in order to be firmly anchored there, it is sufficient if a region of the textile without loops is injection moulded and only the region between the injection-moulded parts has loops.

Since a particular area of application of such hinges lies in the fastening of airbag flaps to the cladding of vehicle, it is proposed that one part of the hinge is an airbag flap.

BRIEF DESCRIPTION OF THE DRAWINGS

An exemplary embodiment of the invention is shown in the drawing and explained in detail by means of the figures. In the figures

DETAILED DESCRIPTION OF THE PREFERRED EMBODIMENTS

Figure 1:
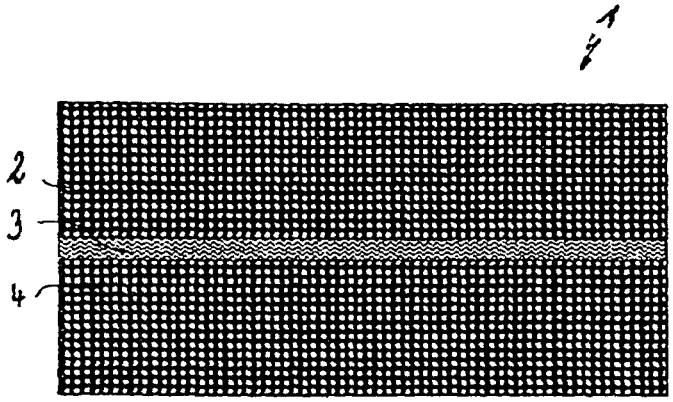
FIG. 1 shows schematically a plan view of a textile for the hinge.

The woven fabric 1 shown in FIG. 1 consists of a first smooth fabric side 2, a central gauze region 3 and a second smooth fabric side 4. When using such a fabric as a hinge, the first smooth fabric side 2 is injection-moulded into a first part 5 and the second smooth fabric side 4 is injection moulded into the second part 6. In the present exemplary embodiment, the first part 5 is a cladding part in the interior of a motor vehicle whilst the second part 6 is an airbag flap.

In this exemplary embodiment, the textile is a double warp fabric which is divided into the first smooth fabric side 2, the central gauze region 3 and the second smooth fabric side 4 and thus into three sections. The two outer sides 2 and 4 are here firmly connected to the cladding part on the one hand and the airbag flap on the other hand by overmoulding. To this end the fabric can advantageously be wetted with an adhesion promoter and/or have openings so that the polymer can pass through these openings and produce a tight fit to the fabric.

Preferably the material composition of the base warp and the weft is matched to the polymer in such a manner that the sides 2 and 4 of the fabric are joined seamlessly to the cladding part or the airbag flap in the injection moulding process. In this case, the threads both of the pile warp and of the base warp are configured to be stretched in the regions of the sides 2 and 4.

The central part 3 is configured as gauze made of loops. In such a loop fabric the threads of the pile warp form the loops. In this case the loops can be formed on both sides and on one side.

The parts 5 and 6 are not only connected to one another via the textile 1 but also via a web 7 which is configured to be narrower than the remaining thickness of the parts 5 and 6. A predetermined breaking point is thereby formed on the web 7. In addition, a gap 8 is formed next to the web 7, which is bridged by the textile 1.

The textile 1 is injection-moulded into the parts 5 and 6 in such a manner that the region 3 of the textile 1 with the loops lies in the gap 8.

In this gap 8 the loops can be formed on both sides of the textile 1 and also only on one side.

If loops are only provided on one side, it is proposed to attach these to the side of the textile 1 facing away from the web 7. In addition, it is proposed not to introduce the textile 1 into the parts 5 and 6 centrally but also in a region of the side facing away from the web 7 as shown schematically in FIG. 2.

Figure 2:
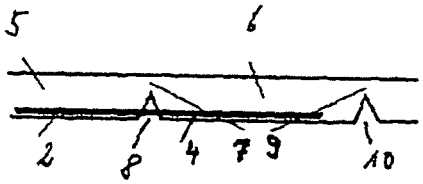
FIG. 2 shows schematically a hinge with injection-moulded textile.

In the example of an airbag flap, the flap formed by the part 6 is connected to the part 5 of the cladding all around via a circumferential predetermined breaking point. Thus, FIG. 2 shows a second web 9 and a second gap 10 which form a predetermined breaking point in which no hinge-forming fabric is incorporated.

Figure 3:
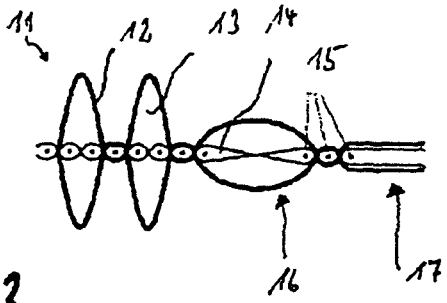
FIG. 3 shows schematically a cutaway side view of the gauze region of the textile.

The section of a loop fabric shown in FIG. 3 shows a first region 11 in which the threads 12 of the pile warp are pushed onto loops 13. The loops are held in shape by the threads 14 of the base warp and the weft threads 15.

In the event of an elongation and in particular a tearing of the threads 14 of the base warp, as shown in the regions 16 and 17, the spacing of the weft threads 15 increases so that at the latest after tearing of the base fabric, that is the threads 14 of the base fabric, the desired lengthening of the fabric is established.

For a hinge on an airbag flap, it is proposed to provide five rows of loops where the loops have a length of 5 to 20 mm and protrude at the side of the textile 1 facing away from the web 7. A loop length of 5 to 20 mm has also proved successful for other areas of application.

The defined lengthening of the fabric ensures that for such cases of application the fabric need not be laid as a loop. The automation of the process is thereby facilitated if the textile is laid with the airbag flap during manufacture of the cladding part.

A connection without additional connecting parts is made possible whereby the textile surface structure is overmoulded by the polymer of the airbag flap and that of the cladding part.

Since an elongation is only possible in the free central region 3 between the injection moulded sides 2 and 4 of the fabric 1, the loop region can be limited to this region with the result that the use of material for the loop material can be reduced.

The lengthening can be defined within narrow tolerances by the length of the loops adjusted during the weaving process and the constructively specified number of rows of loops.

When such a hinge is used for an airbag flap, after triggering of the gas generator the airbag exerts a force on the airbag flap so that this tears at the webs 7 and 9 and the airbag flap as part 6 is only connected via the textile 1 to the cladding, the part 5. Due to the force of the airbag, such a force is exerted on the airbag flap that the textile 1 is stretched. The textile 1 thus becomes a hinge strip which holds the airbag flap at a defined distance from the cladding region to which the airbag flap is connected via the textile fabric 1.

The invention claimed is:

1. Hinge comprising a textile which connects a first part and a second part to one another, wherein the textile is a woven fabric and has a gauze made of loops between the parts; and wherein the textile comprises a double warp fabric whose base warp has a lower strength than a pile warp.

2. The hinge according to claim 1, wherein the strength of the base warp is 500 N/5 cm to 2,000 N/5 cm.

3. The hinge according to claim 1, wherein the strength of the pile warp is at least 1.3 times the strength of the base warp.

* * * * *